US007384896B2

(12) United States Patent
George et al.

(10) Patent No.: US 7,384,896 B2
(45) **Date of Patent: *Jun. 10, 2008**

(54) CONTROLLED RELEASE OF ADDITIVE GEL(S) FOR FUNCTIONAL FLUIDS

(75) Inventors: Herman F. George, Chardon, OH (US); James D. Burrington, Mayfield Village, OH (US); John K. Pudelski, Cleveland Heights, OH (US); James P. Roski, Willowick, OH (US); John R. Martin, Concord Township, OH (US); Jennifer M. Ineman, Cleveland, OH (US); Gary A. Garvin, Mentor, OH (US); Frank M. van Lier, Lyndhurst, OH (US); David A. McCaughey, Hudson, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 521 days.

This patent is subject to a terminal disclaimer.

(21) Appl. No.: 11/045,815

(22) Filed: Jan. 28, 2005

(65) Prior Publication Data

US 2005/0137097 A1 Jun. 23, 2005

Related U.S. Application Data

(63) Continuation-in-part of application No. 10/964,435, filed on Oct. 13, 2004, which is a continuation of application No. 10/196,441, filed on Jul. 16, 2002, now Pat. No. 6,843,916.

(51) Int. Cl.
*C10M 159/22* (2006.01)
*C10M 159/24* (2006.01)
*C10M 159/20* (2006.01)

(52) U.S. Cl. ..... 508/291; 508/574; 508/460; 508/391

(58) Field of Classification Search ..... 508/291, 508/391, 460, 574
See application file for complete search history.

(56) References Cited

U.S. PATENT DOCUMENTS

| | | | | |
|---|---|---|---|---|
| 3,336,223 | A | 8/1967 | Kneeland | 252/9 |
| 3,749,247 | A | 7/1973 | Rohde | 210/205 |
| 3,883,439 | A * | 5/1975 | Bergeron | 508/339 |
| 4,014,794 | A | 3/1977 | Lewis | 210/199 |
| 4,061,572 | A | 12/1977 | Cohen et al. | 210/168 |
| 4,066,559 | A | 1/1978 | Rohde | 252/10 |
| 4,075,098 | A | 2/1978 | Paul et al. | 210/168 |
| 4,144,166 | A | 3/1979 | DeJovine | 210/60 |
| 4,144,169 | A | 3/1979 | Grueschow | 210/168 |
| 4,601,799 | A | 7/1986 | Froberger et al. | 204/181.8 |
| 4,639,255 | A | 1/1987 | Schuettenberg et al. | 44/62 |
| 4,751,901 | A | 6/1988 | Moor | 123/196 A |
| 4,755,289 | A | 7/1988 | Villani | 210/132 |
| 4,769,167 | A * | 9/1988 | Haas et al. | 252/76 |
| 4,906,389 | A | 3/1990 | Brownawell et al. | 252/25 |
| 4,977,871 | A | 12/1990 | Brownawell et al. | 123/196 A |
| 5,032,259 | A | 7/1991 | He et al. | 210/133 |
| 5,042,617 | A | 8/1991 | Brownawell et al. | 184/6.24 |
| 5,059,217 | A | 10/1991 | Arroyo et al. | 44/639 |
| 5,069,799 | A | 12/1991 | Brownawell et al. | 210/749 |
| 5,249,552 | A | 10/1993 | Brooks | 123/1 |
| 5,327,861 | A | 7/1994 | Rogalla et al. | 123/196 S |
| 5,374,354 | A | 12/1994 | Baehler et al. | 210/168 |
| 5,422,022 | A | 6/1995 | Chamberlin, III | 252/32.5 |
| 5,435,912 | A | 7/1995 | Baehler et al. | 210/168 |
| 5,456,217 | A | 10/1995 | Thunker et al. | 123/1 A |
| 5,478,463 | A | 12/1995 | Brownawell et al. | 208/180 |
| 5,507,942 | A | 4/1996 | Davis | 210/94 |
| 5,527,452 | A | 6/1996 | Grigoriev et al. | 210/130 |
| 5,552,040 | A | 9/1996 | Baehler et al. | 210/168 |
| 5,573,557 | A | 11/1996 | Thünker et al. | 44/639 |
| 5,580,359 | A | 12/1996 | Wright | 44/321 |

(Continued)

FOREIGN PATENT DOCUMENTS

EP 0258426 B1 7/1990

(Continued)

OTHER PUBLICATIONS

Pirro, D.M. and Wessol, A.A., Lubrication Fundamentals, Second Ed., Marcel Dekker, New York, 2001, Chapter 3.*

(Continued)

*Primary Examiner*—Glenn Caldarola
*Assistant Examiner*—Jim Goloboy
(74) *Attorney, Agent, or Firm*—Christopher D. Hilker; Teresan W. Gilbert

(57) ABSTRACT

In accordance with the present invention, it has been discovered that additive gels can provide additives to a functional fluid over time. In accordance with the present invention it has been discovered that an additive gel comprising i.) at least two additives selected from the group comprising detergents, dispersants, acids, bases, over based detergent, succinated polyolefins or mixtures thereof wherein the selected additives when combined form a gel;

ii.) optionally at least one additive comprising viscosity modifier(s), friction modifier(s), detergent(s), cloud point depressant(s), pour point depressant(s), demulsifier(s), flow improver(s), anti static agent(s), dispersant (s), antioxidant(s), antifoam(s), corrosion/rust inhibitor (s), extreme pressure/antiwear agent(s), seal swell agent(s), lubricity aid(s), antimisting agent(s), and mixtures thereof;

resulting in a controlled release gel that over time releases at least one desired additive into a functional fluid when the gel is contacted with the functional fluid.

15 Claims, No Drawings

U.S. PATENT DOCUMENTS

| | | | | |
|---|---|---|---|---|
| 5,591,330 | A | 1/1997 | Lefebvre | 210/203 |
| 5,662,799 | A | 9/1997 | Hudgens et al. | 210/192 |
| 5,695,531 | A | 12/1997 | Makino et al. | 44/639 |
| 5,718,258 | A | 2/1998 | Lefebvre et al. | 137/268 |
| 5,725,031 | A | 3/1998 | Bilski et al. | 141/2 |
| 5,767,045 | A * | 6/1998 | Ryan | 508/287 |
| 5,776,494 | A | 7/1998 | Guskey et al. | 424/484 |
| 5,837,657 | A | 11/1998 | Fang et al. | 508/363 |
| 5,897,770 | A | 4/1999 | Hatch et al. | 210/101 |
| 6,008,165 | A * | 12/1999 | Shanklin et al. | 508/185 |
| 6,045,692 | A | 4/2000 | Bilski et al. | 210/198.1 |
| 6,127,321 | A * | 10/2000 | Emert et al. | 508/192 |
| 6,140,279 | A * | 10/2000 | Emert et al. | 508/192 |
| 6,187,721 | B1 | 2/2001 | Goldblatt et al. | 508/221 |
| 6,207,625 | B1 | 3/2001 | Ogano et al. | 508/365 |
| 6,238,554 | B1 | 5/2001 | Martin, Jr. et al. | 210/109 |
| 6,268,316 | B1 | 7/2001 | Tanaka et al. | 508/291 |
| 6,310,010 | B1 | 10/2001 | Higton et al. | 508/192 |
| 6,520,902 | B1 | 2/2003 | Brown et al. | 494/24 |
| 6,579,218 | B1 | 6/2003 | May et al. | 494/24 |
| 6,605,571 | B1 | 8/2003 | Higton et al. | 508/185 |
| 6,689,725 | B1 | 2/2004 | Gao | 508/364 |
| 6,784,142 | B2 | 8/2004 | Van Dam et al. | 508/192 |
| 6,843,916 | B2 | 1/2005 | Burrington et al. | 210/416.5 |
| 6,860,241 | B2 | 3/2005 | Martin et al. | 123/1 A |
| 7,056,870 | B2 | 6/2006 | Chapaton et al. | 508/208 |
| 7,087,674 | B2 | 8/2006 | Sarkar et al. | 524/560 |
| 7,163,482 | B2 | 1/2007 | Sarkar et al. | 475/159 |
| 2002/0014447 | A1 | 2/2002 | Rohrbach et al. | 210/209 |
| 2002/0043495 | A1 | 4/2002 | Beard et al. | 210/416.1 |
| 2004/0014614 | A1 | 1/2004 | Burrington et al. | 508/287 |
| 2004/0157751 | A1 | 8/2004 | Chapaton et al. | 508/124 |
| 2004/0157970 | A1 | 8/2004 | Sarkar et al. | 524/366 |
| 2004/0159304 | A1 | 8/2004 | Caracciolo | 123/196 R |
| 2004/0266631 | A1 | 12/2004 | Burrington et al. | 508/113 |

FOREIGN PATENT DOCUMENTS

| | | |
|---|---|---|
| EP | 0254776 B1 | 3/1991 |
| EP | 0416907 | 3/1991 |
| EP | 0915730 B1 | 5/1999 |
| EP | 0962518 A1 | 12/1999 |
| EP | 1213341 A1 | 6/2002 |
| WO | WO 94/24237 | 10/1994 |
| WO | WO 03/018163 | 3/2003 |
| WO | WO 2005/003255 | 1/2005 |
| WO | WO 2005/003265 | 1/2005 |

OTHER PUBLICATIONS

"Studies on Combustion, Vibration, and Noise in High-Speed Diesel Engines Through Newly Developed Measuring Instruments" (Journal of Eng. For Gas Turbines and Power, Jul. 1988, vol. 110, pp. 377-384).

"Deliverables Prepared for Lubrizol", R. Kolar and S. Cullen, Cupertino, CA (Aurigin Consulting, Aug. 23, 2001).

"Blending of Alcohols with Diesel Fuels", US/GLO/83/039, E.J. Lom and R.R. Reeves, (U.S. Dept. of Commerce, Natl. Tech. Information Service, Springfield, VA, Jan. 3, 1986, pp. 1-243).

"A Review of Zinc Dialkyldithiophosphates (ZDDPS): Characterisation and Role in the Lubricating Oil", A.M. Barnes, K.D. Bartle, V.R.A. Thibon, Elsevier Science Ltd. (Tribology International 34 [2001], pp. 389-395).

* cited by examiner

CONTROLLED RELEASE OF ADDITIVE GEL(S) FOR FUNCTIONAL FLUIDS

RELATED APPLICATIONS

This application is a continuation in part of U.S. Ser. No. 10/964,435 entitled "Slow Release Lubricant Additives Gels" filed Oct. 13, 2004, which is in a continuation of U.S. Ser. No. 10/196,441 entitled "Slow Release Lubricant Additives Gels" filed Jul. 16, 2002, now U.S. Pat. No. 6,843,916.

FIELD OF THE INVENTION

The present invention relates to an additive gel that controlled releases into a functional fluid. Furthermore, the present invention relates to an additive gel that controlled releases into functional fluids of fluid conditioning devices.

BACKGROUND OF THE INVENTION

Functional fluids degrade over time through use. The additives in the functional fluids deplete over the lifetime of the fluid in an engine or other mechanical device. Time release additives for engine oil are known. These additives are typically incorporated into thermoplastic polymers which slowly dissolve into the engine oil, see U.S. Pat. No. 4,075,098. Time release additives have also been incorporated into polymers which are oil-permeable at elevated engine temperatures, see U.S. Pat. No. 4,066,559. In another approach, coating oil additives dissolves over time to release additives into the engine oil, see U.S. patent application Ser. No. 2004/0154304A1.

Replenishment of desired additives into the functional fluid will improve the performance of the functional fluid and the device using the functional fluid.

Accordingly, it is desirable to provide controlled release additives for functional fluids which do not require inert carriers or complicated mechanical devices for achieving controlled release metering of the desired additives into the functional fluid.

SUMMARY OF THE INVENTION

In accordance with the present invention, it has been discovered that additive gels can provide additives to a functional fluid over time. In accordance with the present invention it has been discovered that an additive gel comprising i.) at least two additives selected from the group comprising detergents, dispersants, acids, bases, over based detergent, succinated polyolefins or mixtures thereof wherein the selected additives when combined form a gel;

ii.) optionally at least one additive comprising viscosity modifier(s), friction modifier(s), detergent(s), cloud point depressant(s), pour point depressant(s), demulsifier(s), flow improver(s), anti static agent(s), dispersant(s), antioxidant (s), antifoam(s), corrosion/rust inhibitor(s), extreme pressure/antiwear agent(s), seal swell agent(s), lubricity aid(s), antimisting agent(s), and mixtures thereof; resulting in a controlled release gel that over time releases at least one desired additive into a functional fluid when the gel is contacted with the functional fluid.

The present invention provides a process for supplying one or more desired additives to a functional fluid by contacting the functional fluid with the additized controlled release gel.

DETAILED DESCRIPTION

In accordance with the present invention, a controlled release additive gel is provided for a fluid conditioning device(s). The present invention provides a process for supplying one or more desired additives to a functional fluid by contacting the functional fluid with the additized controlled release gel.

The present invention of a controlled release additive gel can be used in any fluid conditioning device including internal combustion engines which include mobile and stationary applications; hydraulic systems; automatic transmissions; gear boxes which include manual transmissions and differentials; metalworking fluids; pumps; suspension systems; other lubricated mechanical systems; and the like. The fluid conditioning devices that can use the additive gel include, internal combustion engines, stationary engines, generators, diesel and/or gasoline engines, on highway and/or off highway engines, two-cycle engines, aviation engines, piston engines, marine engines, railroad engines, biodegradable fuel engines and the like; lubricated mechanical systems such as gear boxes, automatic transmissions, differentials, hydraulic systems and the like.

The functional fluid becomes diminished and depleted of its additives over time. The additive gel is specifically formulated to meet the desired performance requirements of the functional fluid system and to condition the fluid. The present invention provides for the use of a controlled release additive gel to increase the performance of the functional fluid by replenishing the depleted desired additives or introducing new desired additives to the functional fluid. Thus the functional fluid can add and/or maintain consistent performance over the functional fluid's life because the device should perform closer to optimum for a longer period of time.

The functional fluids useful to be readditized through the controlled release additized gel include gear oil, transmission oil, hydraulic fluid, engine oil, two cycle oil, metalworking fluid and the like. In one embodiment the preferred fictional fluid is an engine oil. In another embodiment the preferred functional fluid is gear oil. In another embodiment the preferred functional fluid is transmission fluid. In another embodiment the preferred functional fluid is a hydraulic fluid.

The additive gel dissolves into the functional fluid by contacting the additive gel with the functional fluid in the system. The additive gel is positioned anywhere the additive gel will be in contact with the functional fluid. In one embodiment, the additive gel is positioned anywhere that the circulating functional fluid contacts the additive gel. In one embodiment the functional fluid is an engine oil and the additive gel is positioned in the engine oil system which includes the lubricating system, filter, drain pan, oil bypass loop, canister, housing, reservoir, pockets of a filter, canister in a filter, mesh in a filter, canister in a bypass system, mesh in a bypass system, oil lines and the like. In one embodiment the functional fluid is a gear oil and the additive gel is located in the gear system which includes oil drain pan, sump, filters, a full flow or bypass oil line, lines, loop and/or filter, canisters, mesh, other spaces within the device in which a gel might be contained and the like. In one embodiment the functional fluid is transmission fluid and the additive gel is located in the transmission system which includes the space such as a hole within a transmission magnet, the oil pan, oil lines, lines, canisters, mesh and the like. In one embodiment the additive gel is located in the engine oil line, which includes a full flow filter, a by-pass filter, the oil pan, and the like. In one embodiment, the functional fluid is a hydraulic fluid and the additive gel is located in the hydraulic cylinder, sump, filter, oil lines, pan, full flow or by pass oil loop, line and/or filter, canister, mesh, other spaces in the system and the like.

One or more locations in a line, loop and/or the functional fluid system can contain the additive gel. Further, if more than one additive gel for the fictional fluid is used the additive gel can be identical, similar and/or a different additive gel composition.

In one embodiment it is desirable to provide a container to hold the additive gel, such as a housing, a canister or a structural mesh anywhere in the functional fluid system, for example, a canister within a bypass loop of a stationary gas engine for power generation. The necessary design feature for the container is that at least a portion of the additive gel is in contact with the functional fluid.

The additive gel needs to be in contact with the functional fluid. In one embodiment the additive gel is in contact with the functional fluid in the range of about 100% to about 1% of the functional fluid in the system, in another embodiment the additive gel is in contact with the functional fluid in the range of about 75% to about 25% of the functional fluid in the system and in another embodiment the additive gel is in contact with the functional fluid in the range of about 50% of the functional fluid in the system. As the flow rate decreases there is less dissolution of the additive gel and as the flow rate increases there is greater dissolution of the additive gel.

In one embodiment, the additive gel is positioned in the functional fluid system so that the additive gel and/or spent additive gel can easily be removed, and then replaced with a new and/or recycled additive gel.

The additive gel is added to the system by any known method depending on the total amount of gel that is desired to be released over time, the desired form of the additive gel (e.g. stiffness, consistency, homogeneity and the like), the desired overall dissolution of the gel, the desired release rates of a specific component, the desired mode of operation and/or any combinations of the above.

The release rate of the additive gel is determined primarily by the additive gel formulation. The release rate is also dependent on the mode of addition of the additive gel, the location of additive gel, flow rate of the functional fluid, the form of the additive gel (e.g., stiffness, consistency, homogeneity and the like) and the like. The additive gel is positioned in a location desirable for the specified and desirable dissolution rate of the additive gel components.

The additive gel's formulation may be composed of one or more components that selectively dissolve or a portion of one or more components remain till the end of its service life or combinations thereof. In general, the components in category ii will typically dissolve faster than the components in category i. This allows a desired component(s) (category ii) to be selectively released into the functional fluid while other components remain undissolved or less dissolved. Thus depending on the fluid conditioning device and its functional fluid, the gel would contain the desired component(s) in category ii to dissolve into the functional fluid to replace or introduce the desired additive.

In one embodiment, it has been found that the gel slowly dissolves its component additive parts into the functional fluid when exposed to heated fluid with no or limited flow over the surface of the gel. The rate of dissolution of additive gel under these conditions is controlled to be slow, and because the gel dissolves into its component additives, it effectively achieves slow and selective release of the desired additives into the functional fluid. If exposure to the hot fluid is continued beyond the point that certain additive(s) are selectively released, the gel will continue to dissolve over time so that the other additives, i.e. category i components, continue to be released. These release rates can be optimized, using the parameters described above, so that the desired gel component(s) are released over a substantial portion to all of the functional fluid's useful life.

The gel can be used as is, without an inert carrier or a non additive matrix, such as a polymeric backbone or complicated mechanical systems needed in earlier systems for achieving controlled release of additives over time.

The gel is a mixture of two or more additives from category i component that when combined form a gel and further contain at least one additive from category ii components. The gel exists in a semi-solid state more like a solid than a liquid, see Parker, Dictionary of Scientific and Technical Terms, Fifth Edition, McGraw Hill, © 1994. See, also, Larson, "The Structure and rheology of Complex Fluids", Chapter 5, Oxford University Press, New York, New York, © 1999, each which is incorporated herein by reference. The rheological properties of a gel can be measured by small amplitude oscillatory shear testing. This technique measures the structural character of the gel and produces a term called the storage modulus which represents storage of elastic energy and the loss modulus which represents the viscous dissipation of that energy. The ratio of the loss modulus/storage modulus, which is called the loss tangent, or "tan delta", is >1 for materials that are liquid-like and <1 for materials that are solid-like. The additive gels have tan delta values in one embodiment of about $\leqq 0.75$, in another embodiment of about $\leqq 0.5$ and in another embodiment of about $\leqq 0.3$. The gels have tan delta values in one embodiment of about $\leqq 1$, in one embodiment of about $\leqq 0.75$, in one embodiment of about $\leqq 0.5$ or in one embodiment of about $\leqq 0.3$.

The additive gel contains a combination of gelling additives of category i components in the range of about 0.01% to about 95%, in one embodiment in the range of about 0.1% to 80% and in another embodiment in the range of about 1% to about 50% of the total weight of the gel.

The additive gel contains a combination of optional additives of the category ii components in the range of about 0.1% to about 95%, in one embodiment in the range of about 0.1% to 90%, in another embodiment in the range of about 0.1% to about 80%, and in another embodiment in the range of about 0.5% to about 50% of the total weight of the additive gel.

In accordance with the present invention, any gel formed from the combination of two or more additives comprising detergents, dispersants, acids, bases, oven based detergents, succinated polyolefins, and the like can be used to make the additive gel. The additive gel comprises at least two additives selected from the group including detergents, dispersants, acids, bases, over based detergent, succinated polyolefins or mixtures thereof wherein such selected additives when combined form a gel. Further in one embodiment the additive gel includes combining dispersants, or combining a dispersant and an acid, or combining a dispersant and a base, or a dispersant and an over based detergent, and the like.

In one embodiment, a category of gels which finds particular use are those in which gellation occurs through the combination of an overbased detergent and an ashless succinimide dispersant. In one embodiment, the ratio of the detergent to the dispersant is from about 10:1 to about 1:10, in another embodiment from about 5:1 to about 1:5, form about 4:1 to about 1:1 and in another embodiment from about 4:1 to about 2:1. In addition, the TBN of the overbased detergent which participates in the gel-forming matrix, is normally at least 200, more typically at 300-1,000 and most typically 350 to 650. Where mixtures of overbased detergents are used, at least one should have a TBN value within these ranges. However, the average TBN of these mixtures may also correspond to these values.

The dispersant includes dispersants; ashless type dispersants such as Mannich dispersants; polymeric dispersants; carboxylic dispersants; amine dispersants, high molecular weight (Cn wherein n≦12) esters and the like; esterfied maleic anhydride styrene copolymers; maleated ethylene diene monomer copolymers; surfactants; emulsifiers' functionalized derivatives of each component listed herein and the like; and combinations and mixtures thereof. In one embodiment the preferred dispersant ispolyisobutenyl succinimide dispersant.

The dispersants includes ashless-type dispersants, polymeric dispersants, mannich dispersants, high molecular weight (Cn wherein n≧12) esters, carboxylic dispersants, amine dispersants and combinations thereof. The dispersant may be used alone or in combination.

The dispersant in the gel includes but is not limited to an ashless dispersant such as a polyisobutenyl succinimide and the like. Polyisobutenyl succinimide ashless dispersants are commercially-available products which are typically made by reacting together polyisobutylene having a number average molecular weight ("Mn") of about 300 to 10,000 with maleic anhydride to form polyisobutenyl succinic anhydride ("PIBSA") and then reacting the product so obtained with a polyamine typically containing 1 to 10 ethylene diamine groups per molecule.

Ashless type dispersants are characterized by a polar group attached to a relatively high molecular weight hydrocarbon chain. Typical ashless dispersants include N-substituted long chain alkenyl succinimides, having a variety of chemical structures including typically:

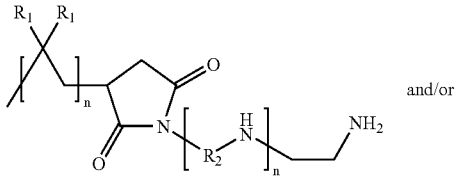

and/or

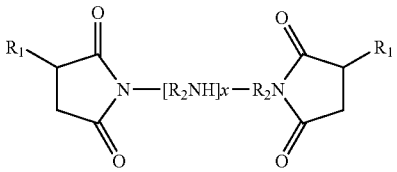

wherein each $R^1$ is independently an alkyl group, frequently a polysiobutyl group with a molecular weight of 500-5000, and $R^2$ are alkenyl groups, commonly ethylenyl ($C_2H_4$) groups. Succinimide dispersants are more fully described in U.S. Pat. No. 4,234,435 which is incorporated herein by reference. The dispersants described in this patent are particularly effective for producing gels in accordance with the present invention.

The Mannich dispersant are the reaction products of alkyl phenols in which the alkyl group contains at least about 30 carbon atoms with aldehydes (especially formaldehyde) and amines (especially polyalkylene polyamines). Mannich bases having the following general structure (including a variety of different isomers and

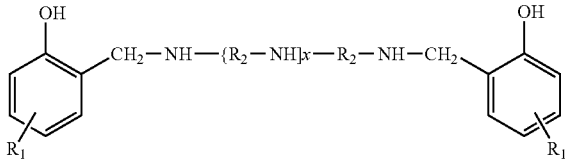

the like) are especially interesting.

and/or

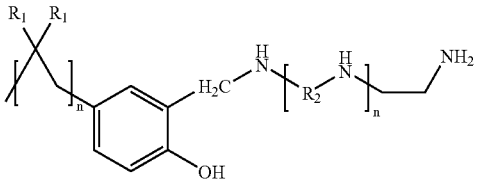

Another class of dispersants is carboxylic dispersants. Examples of these "carboxylic dispersants" are described in Patent U.S. Pat. No. 3,219,666.

Amine dispersants are reaction products of relatively high molecular weight aliphatic halides and amines, preferably polyalkylene polyamines. Examples thereof are described, in U.S. Pat. No. 3,565,804.

Polymeric dispersants are interpolymers of oil-solubilizing monomers such as decyl methacrylate, vinyl decyl ether and high molecular weight olefins with monomers containing polar substituents, e.g., amino alkyl acrylates or acylamides and poly-(oxyethylene)-substituted acrylates. Examples of polymer dispersants thereof are disclosed in the following U.S. Pat. Nos. 3,329,658, and 3,702,300.

Dispersants can also be post-treated by reaction with any of a variety of agents. Among these are urea, thiourea, dimenrcaptothiadiazoles, carbon disulfide, aldehydes, ketones, carboxylic acids, hydrocarbon-substituted succinic anhydrides, nitriles, epoxides, boron compounds, and phosphorus compounds.

Dispersants can be used alone or in combination. The dispersant is present in the range from about 0.01% to about 95% gel, in another embodiment in the range from about 1% to about 70% gel, and preferably in another embodiment in the range from about 5% to about 50% of the additive gel.

The detergents include overbased sulfonates, phenates, salicylates, carboxylates, overbased calcium sulfonate detergents which are commercially-available, overbased detergents containing metals such as Mg, Ba, Sr, Na, Ca and K and mixtures thereof and the like.

Detergents are described, for example, in U.S. Pat. No. 5,484,542 which is incorporated herein by reference. The detergents may be used alone or in combination. Detergents are described, for example, in U.S. Pat. No. 5,484,542 which is incorporated herein by reference.

The detergents may be used alone or in combination. The detergents are present in the range from about 0.01% to about 99%, in one embodiment in the range from about 1% to about 70% and in another embodiment in the range from about 5% to about 50% by weight of the additive gel.

The additive gel contains at least one desired additive for controlled release into the functional fluid. The additive gel desired components include viscosity modifier(s), friction modifier(s), detergent(s), cloud point depressant(s), pour point depressant(s), demulsifier(s), flow improver(s), anti static agent(s), dispersant(s), antioxidant(s), antifoam(s), corrosion/rust inhibitor(s), extreme pressure/antiwear agent (s), seal swell agent(s), lubricity aid(s), antimisting agent(s), and mixtures thereof; resulting in a controlled release gel that over time releases the desired additive(s) into a functional fluid when the gel is contacted with the functional fluid. The desired additive component is further determined by the functional fluid formulation, performance characteristics, function and the like and what additive is desired to be added for depleted additives and/or added new depending on the desired functions.

Antioxidants include alkyl-substituted phenols such as 2,6-di-tertiary butyl-4-methyl phenol, phenate sulfides, phosphosulfurized terpenes, sulfurized esters, aromatic amines, diphenyl amines, alkylated diphenyl amines and hindered phenols, bis-nonylated diphenylamine, nonyl diphenylamine, octyl diphenylamine, bis-octylated diphenylamine, bis-decylated diphenylamine, decyl diphenylamine and mixtures thereof.

The antioxidant function includes sterically hindered phenols and includes but is not limited to 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol 2,6-di-tert-butylphenol, 4-pentyl-2-6-di-tert-butylphenol, 4-hexyl-2,6-di-tert-butylphenol, 4-heptyl-2,6-di-tert-butylphenol, 4-(2-ethylhexyl)-2,6-di-tert-butylphenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, 4-tridecyl-2,6-di-tert-butylphenol, 4-tetradecyl-2,6-di-tert-butylphenol, methylene-bridged sterically hindered phenols include but are not limited to 4,40methylenebis(6-tert-butyl-o-cresol), 4,4-methylenebis(2-tert-amyl-o-cresol), 2,2-methylenebis(4-metyl-6-tert-butylhenol), 4,4-methylene-bis(2,6-di-tertburtylphenol) and mixtures thereof.

Another example of an antioxidant is a hindered, ester-substituted phenol, which can be prepared by heating a 2,6-dialkylphenol with an acrylate ester under based conditions, such as aqueous KOH.

Antioxidants may be used alone or in combination. The antioxidants are typically present in the range of about 0.01% to about 95%, in one embodiment in the range from about 0.01% to 95%, and in another embodiment in the range from about 1.0% to about 70% and in another embodiment in the range from about 5% to about 60% by weight of the additive gel.

The extreme pressure/anti-wear agents include a sulfur or chlorosulphur EP agent, a chlorinated hydrocarbon EP agent, or a phosphorus EP agent, or mixtures thereof. Examples of such EP agents are chlorinated wax, organic sulfides and polysulfides, such as benzxyldisulfide, bis-(chlorobenzyl) disulfide, dibutyl tetrasulfide, sulfurized sperm oil, sulfurized methyl ester of oleic acid sulfurized alkylphenol, sulfurized dispentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphate, i.e., dibutyl phosphate, diheptyl phosphate, dicyclohexyl phosphate, pentylphenyl phosphate; dipentylphenyl phosphate, tridecyl phosphate, distearyl phosphate and polypropylene substituted phenol phosphate, metal thiocarbamates, such as zinc dioctyldithiocarbamate and barium heptylphenol diacid, such as zinc dicyclohexyl phosphorodithioate and the zinc salts of a phosphorodithioic acid combination may be used and mixtures thereof.

The EP/antiwear agent can be used alone or in combination. The EP/antiwear agents are present in the range of about 0% to about 20%, in one embodiment in the range from about 0.25% to about 10% and in another embodiment in the range from about 0.5% to about 25% by weight of the additive gel.

The antifoams include organic silicones such as poly dimethyl siloxane, poly ethyl siloxane, polydiethyl siloxane, polyacrylates and polymethacrylates, trimethyl-triflouropropylmethyl siloxane and the like.

The antifoams may be used alone or in combination. The antifoams are used in the range of about 0% to about 20%, in one embodiment in the range of about 0.02% to about 10% and in anther embodiment in the range of 0.05% to about 2.5% by weight of the additive gel.

The viscosity modifier provides both viscosity improving properties and dispersant properties. Examples of dispersant-viscosity modifiers include vinyl pyridine, N-vinyl pyrrolidone and N,N'-dimethylaminoethyl methacrylate are examples of nitrogen-containing monomers and the like. Polyacrylates obtained from the polymerization or copolymerization of one or more alkyl acrylates also are useful as viscosity modifiers.

Functionalized polymers can also be used as viscosity modifiers. Among the common classes of such polymers are olefin copolymers and acrylate or methacrylate copolymers. Functionalized olefin copolymers can be, for instance, interpolymers of ethylene and propylene which are grafted with an active monomer such as maleric anhydride and then derivatized with an alcohol or an amine. Other such copolymers are copolymers of ethylene and propylene which are reacted or grafted with nitrogen compounds. Derivatives of polyacrylate esters are well known as dispersant viscosity index modifiers additives. Dispersant acrylate or polymethacrylate viscosity modifiers such as Acryloid™ 985 or Viscoplex™ 6-054, from RohMax, are particularly useful. Solid, oil-soluble polymers such as the PIB, methacrylate, polyalkystyrene, ethylene/propylene and ethylene/propylene/1,4-hexadiene polymers, can also be used as visjcosity index improvers. The viscosity modifiers are known and commercially available.

The viscosity modifiers may be used alone or in combination. The viscosity modifiers are present in the range of about 0% to 20%, in one embodiment in the range from about 0.25% to about 10% and in another embodiment in the range from about 0.5% to about 2.5% by weight of the total weight of the additive gel.

The friction modifiers include organo-molybdenum compounds, including molybdenum dithiocarbamate, and fatty acid based materials, including those based on oleic acid, including glycerol mono oleate (GMO), those based on steric acid, and the like.

The friction modifiers can be used alone or in combination. The friction reducing agents are present in the range of about 0% to 10%, in one embodiment in the range from about 0.25% to about 10% and in another embodiment in the range from about 0.5% to about 2.5% by weight of the total weight of the additive gel.

The anti-misting agents include very high (>100,000 Mn) polyolefins such as 1.5 Mn polyisobutylene (for example the material of the trades name Vistanex®), or polymers containing 2-9N-acrylamido), 2-methyl propane sulfonic acid (also known as AMPS®), or derivatives thereof, and the like.

The anti-misting agents can be used alone or in combination. The anti-misting agents are present in the range of about 0% to 10%, in one embodiment in the range from about 0.25% to about 10% and in another embodiment in the range from about 0.5% to about 2.5% by weight of the total weight of the additive gel.

The corrosion inhibitors include alkylated succinic acids and anhydrides derivatives thereof, organo phosphonates and the like. The rust inhibitors may be used alone or in combination. The rust inhibitors are present in the range of about 0% to about 90%, and in one embodiment in the range from about 0.0005% to about 50% and in another embodiment in the range from about 0.0025% to about 30% of the total weight of the additive gel.

The metal deactivators include derivatives of benzotriazoles such as tolyltriazole, N,N-bis(heptyl)-ar-methyl-1H-benzotriazole-1-methanamine, N,N-bis(nonyl)-ar-methyl-1H-Benzotriazole-1-methanamine, N,N-bis(decyl)ar-methyl-1H-Benzotriazole-1-methanamine, N,N-(undecyl) ar-methyl-1H-benzotriazole-1-methanamine, N,N-bis (dodecyl)ar-methyl-1H-Bbenzotriazole-1-methanamine N,N-bis(2-ethylhexyl)-ar-methyl-1H-Bbenzotriazole-1-methanamine and mixtures thereof. In one embodiment the metal deactivator is N,N-bis(1-ethylhexyl)ar-methyl-1H-benzotriazole-1-methanamine;1,2,4-triazoles, benzimidazoles, 2-alkyldithiobenzimidazoles;2-alkyldithiobenzothiazoles; 2-N,N-dialkyldithio-carbamoyl)benzothiazoles;2,5-bis (alkyl-dithio)-1,3,4-thiadiazoles such as 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-octadecyldithio)-1,3,4-thiadiazole, 2,5-bis(tert-nonadecyldithio)-1,3,4-thiadiazole, 2,5-bis(tert-eicosyldithio)-1,3,4-thiadiazole and mixtures thereof; 2,5-bis(N,N-dialkyldithiocarbamoyl)-1,3,4-thiadiazoles; 2-alkydithio-5-mercapto thiadiazoles; and the like.

The metal deactivators may be used alone or in combination. The metal deactivators are present in the range of about 0% to about 90% and in one embodiment in the range from about 0.0005% to about 50% and in another embodiment in the range from about 0.0025% to about 30% of the total weight of the additive gel.

The demulsifiers include polyethylene and polypropylene oxide copolymers and the like. The demulsifiers may be used alone or in combination. The demulsifiers are present in the range of about 0% to about 90%, and in one embodiment in the range from about 0.0005% to about 50% and in another embodiment in the range from about 0.0025% to about 30% of the total weight of the additive gel.

The lubricity aids include glycerol mono oleate, sorbitan-mono oleate and the like. The lubricity additives may be used alone or in combination. The lubricity additives are present in the range of about 0% to about 90% and in one embodiment in the range from about 0.0005% to about 50% and in another embodiment in the range from about 0.0025% to about 30% of the total weight of the additive gel.

The flow improvers include ethylene vinyl acetate copolymers and the like. The flow improvers may be used alone or in combination. The flow improvers are present in the range of about 0% to about 90%, and in one embodiment in the range from about 0.0005% to about 50% and in another embodiment in the range from about 0.0025% to about 30% of the total weight of the additive gel.

The cloud point depressants include alkylphenols and derivatives thereof, ethylene vinyl acetate copolymers and the like. The cloud point depressants may be used alone or in combination. The cloud point depressants are present in the range of about 0% to about 90%, and in one embodiment in the range from about 0.0005% to about 50% and in another embodiment in the range from about 0.0025% to about 30% of the total weight of the additive gel.

The pour point depressants include alkylphenols and derivatives thereof, ethylene vinyl acetate copolymers and the like. The pour point depressant may be used alone or in combination. The pour point depressant are present in the range of about 0% to about 90%, and in one embodiment in the range from about 0.0005% to about 50% and in another embodiment in the range from about 0.0025% to about 30% of the total weight of the additive gel.

The seal swell agents include organo sulfur compounds such as thiophene, 3-(decyloxy)tetrahydro-1,1-dioxide and the like. The seal swell agents may be used alone or in combination. The seal swell agents are present in the range of about 0% to about 90%, and in one embodiment in the range from about 0.0005% to about 50% and in another embodiment in the range from about 0.0025% to about 30% of the total weight of the additive gel.

Optionally, other components can be added to the additive gel which includes base stock oils, inert carriers, dyes, bacteriostatic agents, solid particulate additives, and the like so long as these components do not have a detrimental effect on the additive gel.

The additive gel typically contain small amounts (about 5-40%) of base stock oils, which include but are not limited to mineral-based, synthetic or mixtures thereof.

Optionally, an inert carrier can be used if desired. Furthermore, other active ingredients, which provide a beneficial and desired function can also be included in the gel. In addition, solid, particulate additives such as the PTFE, $MoS_2$ and graphite can also be included.

Optionally, the dyes can be used and includes haloalkanes and the like. The dyes may be used alone or in combination. The dyes are present in the range of about 0% to about 90%, and in one embodiment in the range from about 0.0005% to about 50% and in another embodiment in the range from about 0.0025% to about 30% of the total weight of the additive gel.

Optionally, the bacterostatic agents can be used and includes formaldehyde, gluteraldehyde and derivatives, kathan and the like. The basterostatic agents may be used alone or in combination. The bacterostatic agents are present in the range of about 0% to about 90%, and in one embodiment in the range from about 0.0005% to about 50% and in another embodiment in the range from about 0.0025% to about 30% of the total weight of the additive gel.

The components are mixed together sequentially or all together to form a mixture. After mixing of the components of the gel, a cure may be required in order for gelation to occur. If a cure is required, it is typically done in the range of about 20 to about 165 C for about 1 min to about 60 days, preferably at about 50 to about 120 C for about 1 to about 24 hours, more preferably at about 85 to about 115 C for about 4 to about 12 hours. All the gels used in the examples were cured at 100 C for 8 hours.

SPECIFIC EMBODIMENT

For all the examples the components listed in each example in the specification were mixed together to form the gel. The gels was the cured at about 100 C for about 8 hours.

Example 1

Controlled Released Antifoam in an Automatic Transmission Fluid

Antifoams are additives that reduce the foaming tendency and stability of fluids. To be effective at breaking foams, antifoams must be insoluble in the fluid, have a surface tension lower than that of the fluid and be of a particle size of about 2-10 microns when dispersed in the fluid. Because of the insolubility and particle size requirements, an antifoam is usually dispersed in a liquid in which the fluid is soluble, but in which the antifoam is not. For example, the antifoam for a lubricating oil might be dispersed in a mineral base oil, or a lighter solvent such as kerosene. This gives the antifoam limited shelf life because the smaller particles will agglomerate over time and the antifoam will drop out of suspension. When used in an application where shear is applied to the fluid, such as in the lubrication of engines, gear boxes or transmissions, the antifoam can have very limited life, since the particles can be rapidly sheared to a size smaller than the optimal lower limit (about 2 microns), resulting in a fine dispersion which no longer acts as an insoluble foam breaker.

Immobilizing the foam inhibitor in a gel increases the antifoam shelf life because the particles are prevented from coalescing. The gel also serves to protect the antifoam from shear degradation until it is released, thereby improving its performance efficiency.

The controlled release of the antifoam containing gel formulation has been demonstrated along with corresponding reduction in foaming and an improvement in antifoam performance efficiency.

Controlled release of an antifoam agent can be accomplished using a gel composed of:

a. An over based detergent, b. A succinimide dispersant, and c. An antifoam agent.

Example 1A

An antifoam-releasing gel (14 g) of the composition were mixed together, a. Is a 400 TBN overbased Ca sulfonate detergent, about 53.6 wt % b. Is a 2000 MW polyisobutenyl succinimide, about 17.9 wt %, and c. Is a polysiloxane antifoam agent, about 28.6 wt %.

The gel is loaded into the bottom of a passenger car oil filter and placed in an oil line of about 20 L of a commercial engine oil circulating at about 7 gpm at 135 C. An oil sample was taken at regular intervals and the Si content measured by inductively coupled plasma spectometer (ICP) to determine the % of the antifoam that had been released into the oil. The results are shown in Table 1. These results show that controlled release of antifoam can be achieved using a gel of the composition described above.

TABLE 1

| Example 1A | |
|---|---|
| Hours | % Theory |
| 0 | 0.0% |
| 1 | 1.1% |
| 25 | 76.2% |
| 50 | 83.4% |
| 72 | 85.7% |
| 92 | 98.8% |
| 115 | 101.2% |
| 189 | 103.6% |
| 215 | 106.0% |
| 237 | 103.6% |
| 261 | 107.2% |
| 314 | 98.8% |
| 339 | 97.6% |
| 359 | 94.1% |

Examples 1B and 1C

An antifoam-releasing gel of the composition, as follows:

a. a 400 TBN overbased CA sulfonate detergent, about 60 wt %, a 200 MW polyisobutenyl succinimide, about 20 wt %, and b. a polysiloxane antifoam agent, about 20 wt %, is loaded into the center hole of a transmission magnet and the gel-filled magnet placed in a 12 L beaker filled with about 1.26 kg of a commercial Fuchs continuously variable transmission oil. The oil was heated to about 100° C. with stirring by a magnetic stirrer, and an oil sample was taken at 0, 8.5, 24 and 48 hours, as shown in Table 2. The Si content measured by ICP to determine the % of the antifoam that had been released into the oil and a foam test (ASTM D892) was performed to determine changes in foam tendency and foam stability. The results are shown in Table 2.

The results indicate that the slow release of Ca detergent and Si antifoam from the gel occurs over time and that this results in reduced foam tendency.

TABLE 2

| Examples 1B and 1C | | | | | | | | |
|---|---|---|---|---|---|---|---|---|
| | Example | | | | | | | |
| | 3 or 4 | 3 | 3 | 3 | 3, 100% Theory | 4 | 4 | 4, 100% Theory |
| Starting Weight of Gel, Grams | | 2.8 | 2.8 | 2.8 | 2.8 | 2.0 | 2.0 | 2.0 |
| Starting Gel Cone Pen, mm | | 33 | 33 | 33 | | 45 | 45 | |

TABLE 2-continued

| | Examples 1B and 1C | | | | | | | |
|---|---|---|---|---|---|---|---|---|
| | Example | | | | | | | |
| | 3 or 4 | 3 | 3 | 3 | 3, 100% Theory | 4 | 4 | 4, 100% Theory |
| Hours | 0 | 8.5 | 24 | 48 | | 24 | 48 | |
| CALCIUM % | 0.06% | 0.0614% | 0.0626% | 0.0624% | 0.0957% | 0.0646% | 0.0665% | 0.0859% |
| SILICON % | 0.0002% | 0.0012% | 0.0014% | 0.0013% | 0.0144% | 0.0016% | 0.0019% | 0.0105% |
| SEQUENCE NUMBER: 1 | | | | | | | | |
| FOAM TENDENCY milliliter | 310 | 20 | 10 | 20 | | 10 | 10 | |
| FOAM STABILITY milliliter | 0 | 0 | 0 | 0 | | 0 | 0 | |
| SEQUENCE NUMBER: 2 | | | | | | | | |
| FOAM TENDENCY milliliter | 20 | 20 | 20 | 10 | | 20 | 10 | |
| FOAM STABILITY milliliter | 0 | 0 | 0 | 0 | | 0 | 0 | |
| SEQUENCE NUMBER: 3 | | | | | | | | |
| FOAM TENDENCY milliliter | 320 | 310 | 10 | 110 | | 10 | 0 | |
| FOAM STABILITY milliliter | 0 | 0 | 0 | 0 | | 0 | 0 | |

Example 2

Controlled Release of Antioxidant in Stationary Natural Gas Engines

Engines that produce little acid, soot, and other particulate contamination, but degrade mainly by oxidation such as stationary natural gas engines, run hot but cleanly. Thus, depletion in antioxidant is the major source of oil loss, oil quality and oil condemnation. Controlled release of an antioxidant can be accomplished using a gel composed of:

a. an overbased detergent,
b. a succinimide dispersant,
c. an ashless antioxidant, and
d. a polysuccinated polyolefin.

Example 2

The composition is as follows:

a. a 400 TBN overbased Ca sulfonate detergent, about 34 wt %
b. a 2000 MW polyisobutenyl succinimide, about 6 wt %
c. a C16/C18 mixed ester of 2-cinanamylphenol, about 50 wt %, and
d. a 2000 MW polyisobutenyl succan, about 10 wt %

One kg of the additive gel was placed in a pan. Twelve pans were stacked and placed in a filter housing. The resulting housing was placed in the engine oil line of a Cat 3516 stationary natural gas engine with about a 0.75 gpm oil flow. Oil samples were taken periodically and analyzed for state of oxidation/nitration by infrared spectroscopy. Results are shown in Table 3.

Comparative Example 2

Same as example 2, except with no gel because it was oil diluted to be a fluid. Results are shown in Table 4. The results show that the additive gel protected against oxidation better than the non gel liquid, that is for a given value of time (oil hours) there was less oxidation and nitration in the gel.

TABLE 3

| Comp. Example 1 Oil Hours | % Oxidation | % Nitration |
|---|---|---|
| 1 | 8.8 | 0.0 |
| 69 | 13.6 | 6.3 |
| 117 | 16.8 | 9.4 |
| 165 | 21.6 | 11.9 |
| 237 | 29.6 | 15.9 |
| 285 | 33.2 | 18.2 |
| 333 | 37.2 | 19.8 |
| 410 | 42.8 | 22.2 |
| 457 | 44.8 | 23.2 |
| 505 | 48.4 | 25.1 |
| 578 | 53.2 | 28.4 |
| 626 | 58.4 | 30.3 |
| 674 | 60.4 | 31.4 |
| 746 | 64.0 | 35.2 |
| 794 | 65.2 | 36.2 |
| 842 | 67.2 | 37.3 |
| 913 | 70.4 | 41.8 |
| 962 | 70.4 | 41.6 |
| 1012 | 72.8 | 45.7 |
| 1082 | 75.2 | 50.4 |
| 1130 | 76.8 | 53.6 |
| 1178 | 78.4 | 54.8 |
| 1249 | 80.0 | 58.5 |

TABLE 3-continued

| Comp. Example 1 Oil Hours | % Oxidation | % Nitration |
|---|---|---|
| 1298 | 79.6 | 60.8 |
| 1345 | 82.0 | 64.8 |
| 1416 | 84.4 | 71.1 |
| 1464 | 86.4 | 76.0 |
| 1512 | 87.6 | 75.9 |
| 1564 | 88.8 | 79.8 |

TABLE 4

| Ex 1 - Gel Oil Hours | % Oxidation | % Nitration | Ex 2 - Gel Oil Hours | % Oxidation |
|---|---|---|---|---|
| 0 | 2.5 | 8.8 | 0 | 0.0 |
| 2 | 2.8 | 13.6 | 16 | −0.2 |
| 18 | 3.1 | 16.8 | 88 | 1.4 |
| 66 | 4.8 | 21.6 | 239 | 7.2 |
| 114 | 4.8 | 29.6 | 362 | 13.2 |
| 186 | 10.2 | 33.2 | 529 | 21.8 |
| 234 | 13.0 | 37.2 | 630 | 25.0 |
| 282 | 15.9 | 42.8 | 751 | 28.8 |
| 354 | 16.5 | 44.8 | 919 | 27.2 |
| 402 | 19.3 | 48.4 | 1087 | 33.6 |
| 450 | 21.2 | 53.2 | 1254 | 41.7 |
| 522 | 25.0 | 58.4 | 1422 | 48.0 |
| 570 | 28.0 | 60.4 | 1546 | 54.6 |
| 618 | 30.3 | 64.0 | 1711 | 58.2 |
| 763 | 35.9 | 65.2 | 2070 | 68.2 |
| 949 | 42.4 | 67.2 | | |
| 1117 | 51.2 | 70.4 | | |
| 1285 | 57.2 | 70.4 | | |
| 1406 | 62.6 | 72.8 | | |
| 1574 | 68.4 | 75.2 | | |
| 1742 | 73.2 | 76.8 | | |

Example 3

Controlled Release of Friction Modifiers in Engine Oil

The use of friction modifiers in engine oils to improve fuel economy and reduce wear is known. These materials reduce the coefficient of friction between engine parts by coating metal surfaces with a lubricating layer of chemistry, resulting in lower fuel consumption and wear. Friction modifiers become inactive over time, reducing their effectiveness for reducing friction. Thus, the controlled release of friction modifiers serve as a means to extend the period of friction reduction, within a given service interval, beyond what is possible with conventional fluids.

This "durability" of friction reduction for both extended wear and fuel economy is demonstrated in the examples below.

Controlled release of a friction modifier can be accomplished using a gel composed of:

a. an overbased detergent, a succinimide dispersant, c. a friction modifier, and d. a polysuccinated polyolefin.

About 17.5 g of a friction modifier-releasing gel of the above composition as follows:

a. a 400 TBN overbased Ca sulfonate detergent, about 34 wt % b. a 2000 MW polyisobutenyl succinimide, about 6 wt % c. Mo-dithiodimethyldicarbamate (Mo-DTC), about 50 wt % d. a 2000 MW polyisobutenyl succan, about 10 wt % is loaded into a gel containing/delivery adapter. The loaded adapter is mounted between the oil filter and the oil filter housing on a 2000 Toyota Camry 4-cylinder engine and the engine filled with about 3.8 quarts of Valvoline 5W-30 all-climate engine oil. (100% gel dissolution corresponds to 300 ppm Mo in the oil.) The car is then used under normal city/highway driving conditions for about 1500 miles with oil sample collections about every 500 miles and analysis for Mo and coefficient of friction using the Tonen SRV method. The results (controlled Release, Table 5) are compared to a similar Camry, which had the same oil, but which had been top-treated with 250 ppm Mo-DTC (250 ppm Top treat, Table 5).

TABLE 5

Example 3

| | Controlled Release | Coefficient of Friction | |
|---|---|---|---|
| Miles | Ppm Mo | Controlled Release | 250 ppm Top Treat |
| 1 | 2 | 0.1350 | 0.0710 |
| 500 | 42 | 0.1350 | 0.0710 |
| 1000 | 269 | 0.0370 | 0.0930 |
| 1500 | | 0.0900 | 0.0910 |

The results in Table 5 show that friction modifier can be controlled by being slowly released from the gel, that a lower coefficient of friction can be achieved from controlled release, and that the minimum occurs later in the service interval (i.e., at higher mileage). The latter is indicative of durability of fuel economy and wear protection.

We claim:

1. An additive gel composition comprising i.) an over based detergent, a succinimide dispersant, and a polysuccinated polyolefin wherein the additives when combined form a gel; and ii.) optionally at least one additive comprising viscosity modifier(s), friction modifier(s), detergent(s), cloud point depressant(s), pour point depressant(s), demulsifier(s), flow improver(s), anti static agent(s), dispersant (s), antioxidant(s), antifoam(s), corrosion/rust inhibitor (s), extreme pressure/antiwear agent(s), seal swell agent(s), lubricity aid(s), antimisting agent(s), and mixtures thereof;

resulting in a controlled release gel that over time releases at least one additive into a functional fluid when the gel is contacted with the functional fluid wherein the functional fluid is selected from the group consisting of automatic transmission fluids, gear box fluids, manual transmission fluids, differential fluids, metalworking fluids, suspension system fluids, engine fluids, mechanical system fluids, industrial fluids and combinations thereof.

2. The additive gel of claim of claim 1 wherein the weight ratio of detergent to dispersant is from about 10:1 to about 1:10 and the detergent is an over based detergent having a TBN of at least 200.

3. The additive gel of claim 1 wherein the dispersant is present in a range of about 0.01 wt. % to about 95% of the additive gel, and wherein the detergent is selected from the group consisting of over based sulfonates, phenates, salicylates, carboxylates, over based calcium sulfonate detergents, overbased detergents containing metals such as Mg, Ba, Sr, Na, C and K and mixtures thereof and wherein the detergents are in the range from about 0.01 wt. % to about 99% by wt. of the additive gel.

4. The additive gel of claim 1 is wherein one or more ii components selectively dissolve into the functional fluid.

5. The additive gel of claim 1 wherein the additive component to be released over time is determined by the functional fluid formulation, the performance characteristics of the functional fluid and combinations thereof.

6. The additive gel of claim 1 wherein i component is present in the range from about 0.01 wt. % to about 95 wt. % of the additive gel and wherein ii component is present in the range of about 0% to about 95% by wt. of the additive gel.

7. The additive gel of claim 1 wherein at least one other component is added to the additive gel composition which is selected from the group consisting of base stock oils, inert carriers, dyes, bacteriostatic agents, solid particulate additives and mixtures thereof.

8. The additive gel of claim 1 wherein the ii component additive is an anti-foam agent resulting in a controlled release gel that over time releases an antifoam additive into the functional fluid so as to reduce the foaming tendency and to improve stability of the fluid.

9. The additive gel of claim 1 wherein the gel comprises an over based detergent a succinimide dispersant, an ashless anti-oxidant and a polysuccinated polyolefin resulting in a controlled release gel that over time releases an antioxidant additive into the functional fluid of an engine.

10. The additive gel of claim 1 comprising an over based detergent, a succinimide dispersant, a friction modifier and a polysuccinated polyolefin resulting in a controlled release gel that over time releases the friction modifier into the functional fluid so as to reduce the coefficient friction between metal parts.

11. A process for supplying one or more additives to a functional fluid in a fluid conditioning device comprising contacting the functional fluid with an additive gel comprising i. an over based detergent, a succinimide dispersant, and a polysuccinated polyolefin wherein the additives when combined form a gel; and ii. optionally at least one additive comprising viscosity modifier(s), friction modifier(s), detergent(s), cloud point depressant(s), pour point depressant(s), demulsifier(s), flow improver(s), anti static agent(s), dispersant (s), antioxidant(s), antifoam(s), corrosion/rust inhibitor (s), extreme pressure/antiwear agent(s), seal swell agent(s), lubricity aid(s), antimisting agent(s), and mixtures thereof;

wherein the fluid conditioning device is selected from the group consisting of internal combustion engines, stationary engines, generators, diesel engines, gasoline engines, on highway engines, off highway engines, two cycle engines, aviation engines, piston engines, marine engines, railroad engines, biodegradable fuel engines, lubricating mechanical systems, gear boxes, automatic transmissions, manual transmissions, differentials, hydraulic systems, pumps, suspension systems, lubricant mechanical systems and combinations thereof; and wherein the functional fluid is selected from the group consisting of automatic transmission fluids, gear box fluids, manual transmission fluids, differential fluids, metalworking fluids, suspension system fluids, engine fluids, mechanical system fluids, industrial fluids and combinations thereof.

12. The process of claim 11 wherein at least one additive gel is used for the functional fluid and wherein the additive gel can be identical, similar or a different additive gel composition and can be used in one or more locations in the functional fluid device.

13. A fluid conditioning device selected from the group consisting of internal combustion engines, stationary engines, generators, diesel engines, gasoline engines, on highway engines, off highway engines, two cycle engines, aviation engines, piston engines, marine engines, railroad engines, biodegradable fuel engines, lubricant mechanical systems, gear boxes automatic transmissions, manual transmissions, differentials, hydraulic systems, pumps, suspension systems and combinations thereof wherein functional fluid in the device becomes diminished and/or depleted of its additives over time and wherein the functional fluid is in contact with an additive gel that releases additive into the functional fluid overtime and wherein the additive gel composition comprises i. an over based detergent, a succinimide dispersant, and a polysuccinated polyolefin wherein the additives when combined form a gel and ii. optionally at least one additive comprising viscosity modifier(s), friction modifier(s), detergent(s), cloud point depressant(s), pour point depressant(s), demulsifier(s), flow improver(s), anti static agent(s), dispersant (s), antioxidant(s), antifoam(s), corrosion/rust inhibitor (s), extreme pressure/antiwear agent(s), seal swell agent(s), lubricity aid(s), antimisting agent(s), and mixtures thereof.

14. The device of claim 13 wherein the additive gel is placed in a holder and wherein at least a portion of the additive gel is in contact with the functional fluid.

15. The device of claim 13 wherein the additive gel is in contact with the functional fluid in the range of about 100% to about 1% of the functional fluid.

* * * * *